United States Patent [19]

Koch

[11] 4,344,835

[45] Aug. 17, 1982

[54] METHOD FOR MONITORING AND CONTROLLING HYDROGENATION PRESSURE IN PLANT FOR THE HYDROGENATION OF COAL WITH HYDROGEN TO FORM HYDROCARBONS

[75] Inventor: Klaus Koch, Laatzen, Fed. Rep. of Germany

[73] Assignee: Hermann Berstorff Maschinenbau GmbH, Hannover Kleefeld, Fed. Rep. of Germany

[21] Appl. No.: 225,011

[22] Filed: Jan. 14, 1981

Related U.S. Application Data

[62] Division of Ser. No. 151,763, May 21, 1980, Pat. No. 4,288,405.

[30] Foreign Application Priority Data

Dec. 3, 1979 [DE] Fed. Rep. of Germany ..... 2948550

[51] Int. Cl.[3] ..... C10G 1/00; C10B 47/00; C10B 47/20; C10B 57/12

[52] U.S. Cl. ..... 208/8 R; 208/8 LE; 201/1; 201/33; 201/36; 202/118; 422/112; 277/3; 277/135

[58] Field of Search ..... 422/112; 202/118; 201/1, 33, 36; 277/3, 135; 208/8 R, 8 LE

[56] References Cited

U.S. PATENT DOCUMENTS

| | | | |
|---|---|---|---|
| 3,030,297 | 4/1962 | Schroeder | 208/8 R |
| 3,520,067 | 7/1970 | Winegartner | 208/8 LE X |
| 3,658,654 | 4/1972 | Gutberlet | 201/29 X |
| 3,804,423 | 4/1974 | Broy | 277/3 X |
| 4,106,999 | 8/1978 | Koppelman et al. | 202/118 |
| 4,123,070 | 10/1978 | Peterson | 277/173 X |
| 4,162,957 | 7/1979 | Leonard | 208/8 LE X |
| 4,191,500 | 3/1980 | Oberg et al. | 422/112 X |
| 4,206,713 | 6/1980 | Ryason | 202/118 |
| 4,243,509 | 1/1981 | Senor | 208/8 R |
| 4,248,692 | 2/1981 | Knebel et al. | 208/8 LE |

*Primary Examiner*—Delbert E. Gantz
*Assistant Examiner*—William G. Wright
*Attorney, Agent, or Firm*—Schwartz, Jeffery, Schwaab, Mack, Blumenthal & Koch

[57] ABSTRACT

In plant for hydrogenating coal to form hydrocarbons, wherein coal in powder or piece form is fed from a hopper into a preparation chamber, is compressed, conveyed and heated by a rotor comprising a rotating friction element and passed, through a feed aperture, into a hydrogenation chamber wherein hydrogen is injected into it by nozzles, monitoring and controlling means are provided whereby upon the pressure in the hydrogenation chamber rising above that in the end of the preparation chamber adjacent the hydrogenation chamber, as measured by sensors and gauges, the feed aperture is closed and the rotor is stopped. Preferably the feed aperture is closed by providing a conical portion on the rotor and a conical seat on the cylinder forming the chamber, the rotor normally being held in a position to keep the feed aperture open by an hydraulic cylinder but upon the pressure sensors sensing over pressure in the chamber, the cylinder is vented by control means to close the feed aperture. The rotor is also stopped by the control means.

4 Claims, 3 Drawing Figures

METHOD FOR MONITORING AND CONTROLLING HYDROGENATION PRESSURE IN PLANT FOR THE HYDROGENATION OF COAL WITH HYDROGEN TO FORM HYDROCARBONS

This is a division of application Ser. No. 151,763, filed May 21, 1980, now U.S. Pat. No. 4,288,405.

The invention relates to a method for monitoring and controlling apparatus for the hydrogenation of coal with hydrogen to form hydrocarbons, in which apparatus coal is fed into a preparation chamber in powder or piece form, is compressed and plasticised by frictional heating, the plasticised coal is fed into a hydrogenation chamber, impinged on with hydrogen and hydrogenated at a pressure of up to about 500 bars and a temperature of up to 500° C., after which it is passed to a hot separator.

Since the hydrogenation process is carried out at a gas pressure of up to about 500 bars and temperature of up to about 500° C., care must be taken to prevent the gas pressure in the hydrogenation chamber from spreading into the upstream preparation chamber and from there into a feed hopper. Such propagation of the pressure would involve considerable risks for the upstream units of machinery and workers operating it.

The invention has among its objects to provide a method for monitoring and controlling pressure during the hydrogenation of coal with hydrogen to give hydrocarbons, which will ensure that apparatus arranged in a housing and including a preparation and hydrogenation chamber, will operate reliably and safely in every respect, despite the very high pressures and temperatures required for the hydrogenation process. It is particularly important that the very high pressure required in the hydrogenation chamber for the hydrogenation process should not build up in or spread to adjoining units of machinery.

According to the invention there is provided a method of monitoring and controlling the hydrogenation pressure in apparatus for the hydrogenation of coal with hydrogen to form hydrocarbons, in which apparatus the coal is fed into a preparation chamber in powder or piece form, is compressed, conveyed through the preparation chamber and plasticised by frictional heating, the plasticised coal is fed through a feed aperture communicating the preparation chamber with a hydrogenation chamber, is impinged on with hydrogen and hydrogenated at a pressure of up to about 500 bars and a temperature of up to 500° C., after which it is passed to a hot separator, the method comprising monitoring the pressure in the hydrogenation chamber, monitoring the pressure in the preparation chamber at the end thereof adjacent the hydrogenation chamber, comparing the pressures by control means, and, when the measured pressure in the preparation chamber drops below that in the hydrogenation chamber, closing the feed aperture by the control means, and stopping the conveying movement in the preparation chamber.

According to another aspect of the invention there is provided apparatus for monitoring the hydrogenation pressure in apparatus for hydrogenating coal with hydrogen to form hydrocarbons, which apparatus comprises a cylindrical preparation chamber with a friction element rotatable therein, and an adjoining, cylindrical hydrogenation chamber in communication with the preparation chamber by way of a feed aperture and containing a rotor with mixing vanes and static mixing nozzles projecting through the wall of the hydrogenation chamber for ejecting hydrogen, the monitoring and controlling apparatus comprising a shut-off valve between the preparation chamber and the hydrogenation chamber, the shut-off valve comprising a conical seat in the hydrogenation chamber adjacent the feed aperture and an adjacent portion of the rotor formed with a conical portion to cooperate with the conical seat, a hydraulic cylinder axially to displace the rotor and coupled to control means, pressure sensors connected to the control means disposed in the hydrogenating chamber and in the end of the preparation chamber adjacent the hydrogenating chamber, and a connection from the control means to a drive for the rotor, the control means being effective, when the pressure sensor in the preparation chamber senses a lower pressure there than that sensed by the pressure sensor in the hydrogenation chamber, to cause the hydraulic cylinder to move the rotor axially to close the shut-off valve and to cause the drive to stop rotation of the rotor.

By constantly measuring the pressures in the hydrogenation chamber and in the hydrogenation chamber end of the preparation chamber, and by using the control means communicating with the pressure sensors, one can ensure that when the pressure in the hydrogenation chamber end of the preparation chamber drops below that in the hydrogenation chamber, the shut-off valve will immediately close the feed aperture leading into the hydrogenation chamber. At the same time any conveying movement in the preparation chamber is stopped, so as to prevent any inadmissible build up of conveying pressure in the hydrogenation chamber end of the preparation chamber.

If, for example, the pressure sensor in the hydrogenation chamber shows a pressure of 400 bars and the pressure in the hydrogenation chamber end of the preparation chamber is only 390 bars, the control means will immediately close the feed aperture leading to the hydrogenation chamber. This prevents the pressure of the hydrogenation chamber from spreading into the preparation chamber, with ill effects on the feeding of coal into that chamber, and from escaping from parts of the preparation chamber and feed hopper which are not so highly scaled.

The pressure in the hydrogenation chamber is propondenantly a gas pressure, produced by the hydrogenation process and by the feeding of hydrogen into the hydrogenation chamber.

Since the rotating friction element arranged in the preparation chamber forces the plasticised coal into the hydrogenation chamber, there is considerable axial back pressure on the friction element and thus on the rotor connected thereto; this is absorbed by an appropriately constructed back pressure bearing.

The back pressure is produced primarily by the counter pressure from the hydrogenation chamber and by the conveying action of the friction element towards the hydrogenation chamber.

The invention is diagrammatically illustrated by way of example in the accompanying drawings, in which.

Figure 1:
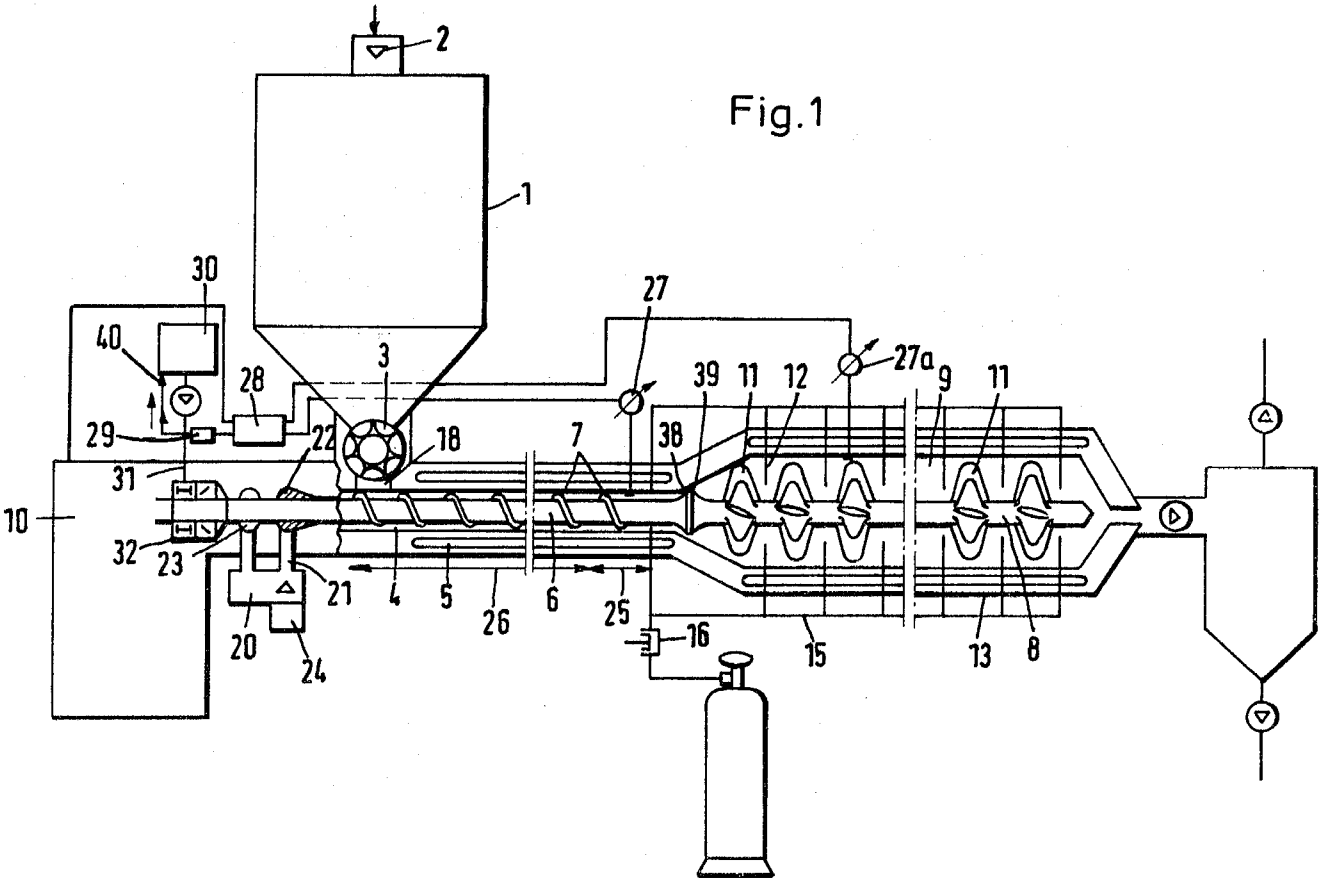
FIG. 1 is a longitudinal section through an installation for hydrogenating coal with hydrogen to form hydrocarbons.

Referring to the drawings, dry coal in powder or piece form which has to be hydrogenated is introduced into a feed hopper 1 through a feed aperture which can be closed by a pressure valve 2. The coal passes through a cellular wheel lock 3 and feed aperture 18 into a treatment chamber 4. The chamber 4 is formed by a cylinder 5 and contains a friction element 6 which is rotated by means of a drive 10 and on which friction webs 7 are provided to produce compression and frictional heat. The friction element 6 is extended in the direction of the hydrogenating chamber 9, in the form of a rotor 8 with vanes 11 on it.

Static mixing nozzles 12 extend radially and axially through the hydrogenating chamber cylinder 13 at equal spacings, towards the axis of the rotor 8. Passages for injecting the hydrogen are formed in the nozzles 12 and are constructed so that they can be closed by non-return valves (not shown). The nozzles 12 are also connected to a hydrogen supply system 15, which can admit hydrogen from a hydrogen source by way of compressor 16.

The coal which is fed into the preparation chamber 4 by means of the cellular wheel lock 3 is compressed by means of the friction webs 7 on the friction element 6 and subjected to intense movement which generates frictional heat and causes the coal to be plasticised. The plasticised coal is fed into the hydrogenating chamber 9.

In the hydrogenating chamber 9 the plastic coal is subjected to intensive mixing and eddying by the mixing vanes 11 on the rotor 8 and the static mixing nozzles 12. At the same time hydrogen is injected into the chamber through the static mixing nozzles 12, thereby setting up and accelerating the hydrogenation reaction, which is exothermic. A temperature of up to about 500° C. and a pressure of up to about 500 bars are required in the chamber 9 in order to carry out the reaction. The pressure is increasingly built up in the direction of the chamber 9 by the rotating friction element 6. There may already be a pressure of up to 500 bars in the preparation chamber 4. A further increase in pressure is provided by the injection of the hydrogen into the chamber 9. Injection of hydrogen is stopped automatically when a preselected pressure is reached.

Measures have to be taken to prevent the pressure prevailing in the preparation chamber 4 from spreading towards the drive 10. In order to obtain a more secure seal in this respect, charge coal which has been ground and mixed with oil is forced into a first annular groove 22 under a pressure higher than that prevailing in the preparation chamber 4. The groove 22 is connected by a pipe 21 to a storage container 20. A compressor 24 puts the container 20 under pressure, and the charge coal thus passes through the pipe 21, into the first annular groove 22 and from there, through a very narrow gap between the drive end of the friction element 6 and the cylinder 5 surrounding it, into the preparation chamber 4. The charge coal forced into the first annular groove 22 is under a pressure higher than that prevailing in the preparation chamber 4. In this way a non-wearing sealing system is obtained.

The charge coal which is pushed towards the drive instead of towards the preparation chamber 4 enters a second annular groove 23, from which it is returned to the storage container 20.

The part 25 of the preparation chamber 4 at the hydrogenation chamber side is provided with a pressure sensor and gauge 27 which communicates with control means 28. The hydrogenation chamber 9 is similarly provided with a pressure sensor and gauge 27*a* which communicates with the control means 28.

The control means 28 acts on a magnetic valve 29 which is in turn connected to a hydraulic pressure source 30. The pressure source 30 communicates with a hydraulic cylinder 32 via a pipe 31.

Figure 2:
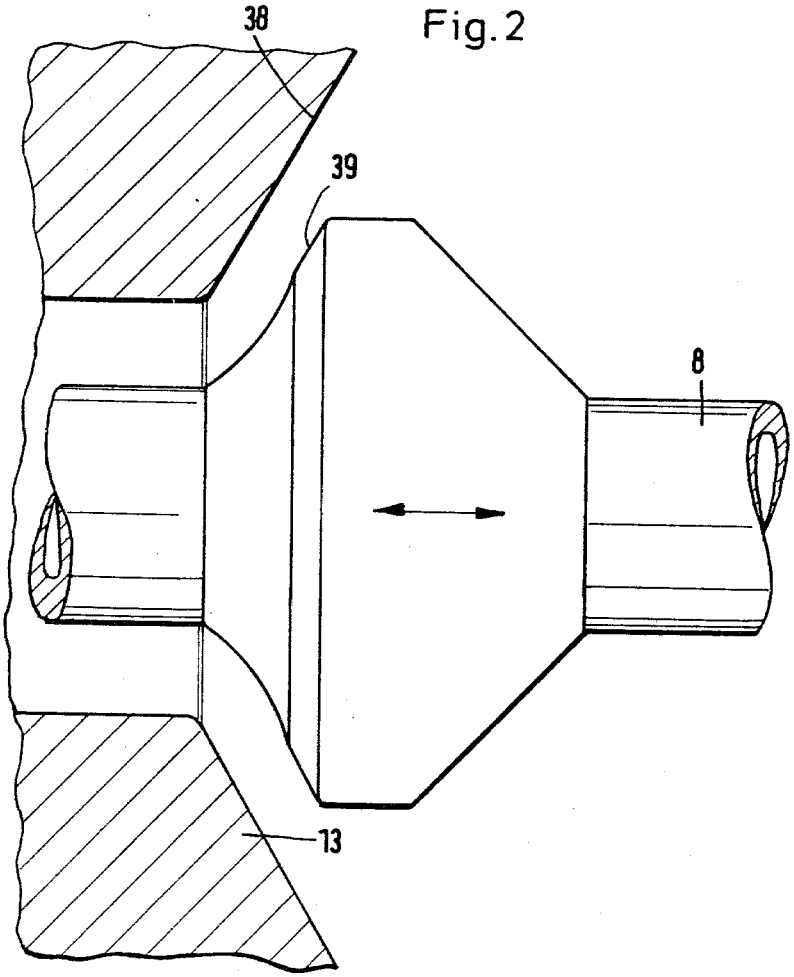
FIG. 2 is a larger scale representation of a conically shaped part of the rotor and of an adjoining conical seat of the installation of FIG. 1.

FIG. 2 shows a conical portion 39 provided on the rotor 8 to cooperate with a conical seat 38 of the cylinder 13. If the rotor 8 is moved axially leftwardly within the cylinder 13 the conical portion 39 of the rotor will abut the conical seat 38 and the hydrogenating chamber 39 will be sealed off from the preparation chamber 4.

Figure 3:
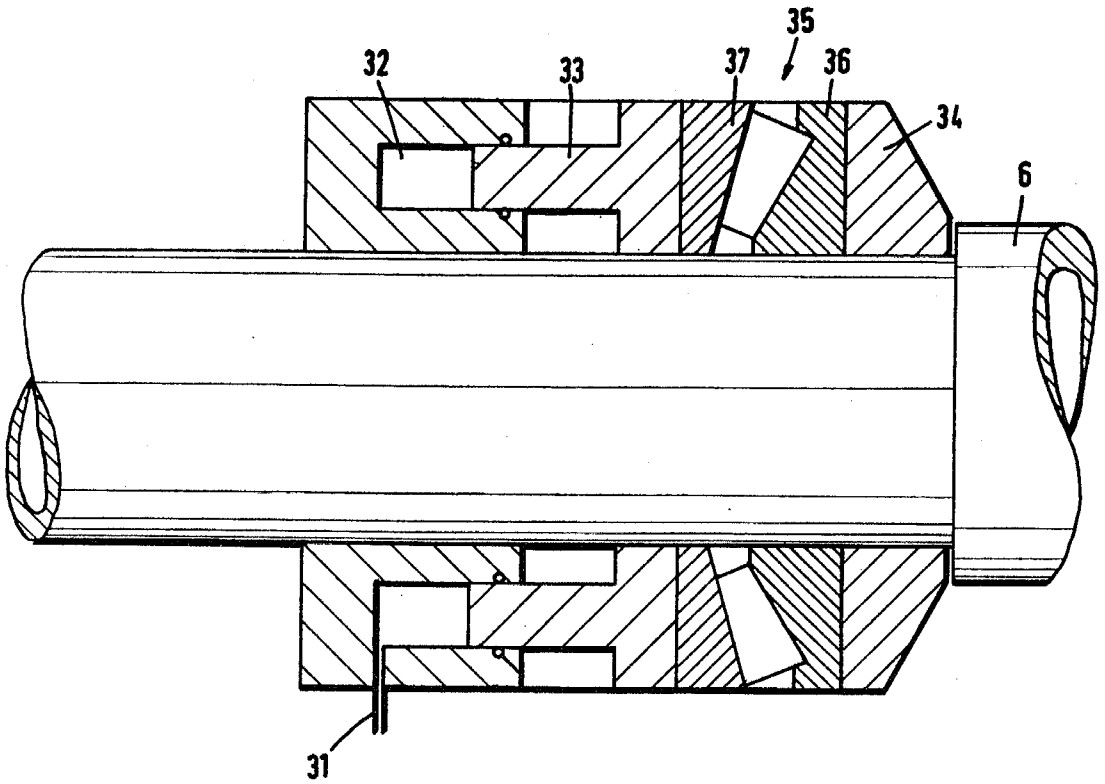
FIG. 3 shows an embodiment of a hydraulic cylinder for axial displacement of the rotor or friction element of the installation of FIG. 1.

The drive-end of the friction element 6 is shown in FIG. 3. The friction element 6 is supported axially on a co-rotating pressure member 34, which is non-rotatably connected to a race 36 of a back pressure bearing in the form of a tapered roller bearing 35. The race 37 is non-rotatably connected to the annular piston 33 of the cylinder 32. Seals are provided to ensure that the cylinder 32 is really tight.

The liquid, solid and gaseous products of hydrogenation are conveyed out of the chamber 9 into a hot separator which is closed by means of non-return valves.

The non-return valve which shuts off the chamber 9 from the hot separator is adjusted so that, when a preselected pressure in the hydrogenation chamber 9 is exceeded, the valve opens to allow the hydrogenation products to be carried into the separator for further treatment.

The operation of the apparatus for carrying out the method of monitoring the hydrogenation pressure will now be described.

The pressure is constantly measured by the sensor and gauge 27 in the preparation chamber 4 and the sensor and gauge 27*a* in the hydrogenation chamber 9, and compared by the control means 28. If the pressure in the chamber 4 drops below that in the chamber 9, the control means 28 actuates the magnetic valve 29, causing it to open. The hydraulic fluid contained at high pressure in the cylinder 32 is thus forced through pipes 31 and 40 into the pressure source 30.

This step causes the rotor 8, which is non-rotatably connected to the friction element 6, to move immediately in an axial direction towards the drive 10 i.e. leftwardly, and the conical seat 38 and conical surface 39 to be pressed together. At the same time the control means 28 exerts a disconnecting action on the drive 10, thereby interrupting any further conveying of charge coal into the hydrogenating chamber 9.

The axial movement of the rotor 8 and friction element 6 takes place automatically when the cylinder 32 is vented, i.e. relieved of pressure, because an axial conveying acton and thus a considerable axial back pressure is provided by the rotating friction element 6. The friction element 6 and rotor 8 are therefore constantly under a very high back pressure, which has to be overcome by the pressure in the cylinder 32. When they are relieved of pressure by the switching over of the magnetic valve 29, the rotor 8 and element 6 slide immediately towards the drive i.e. leftwardly and thus close the annular feed aperture leading into the hydrogenation chamber 9. This ensures that the very high gas pressure in the hydrogenation chamber cannot spread into the preparation chamber 4 or feed hopper 1, where it would considerably disturb the operation.

What is claimed is:

1. A method of monitoring and controlling the hydrogenation pressure in apparatus for the hydrogenation of coal with hydrogen to form hydrocarbons, in which apparatus the coal is fed into a preparation chamber, is compressed and conveyed by means of a rotatable element connected to a drive means through the preparation chamber and plasticized by frictional heating, the plasticized coal is fed through a feed aperture communicating the preparation chamber with the hydrogenation chamber, and said plasticized coal is impinged on with hydrogen and hydrogenated at a pressure of up to 500 bars and a temperature of up to 500° C., after which it is passed to a separator, said method comprising the steps of:

(a) monitoring the pressure in said hydrogenation chamber;

(b) monitoring the pressure in said preparation chamber at the end adjacent said hydrogenation chamber, (c) comparing said pressures, (d) closing said feed aperture responsive to said comparison, and (e) stopping said conveying of said compressed coal in said preparation chamber when said measured pressure in said preparation chamber drops below said measured pressure in said hydrogenation chamber.

2. A method as claimed in claim 1 wherein said feed aperture comprises a conical seat adjacent and adapted to engage a conical surface on said rotatable element, and wherein said closing step further comprises moving said rotatable element to a position where said conical surface engages said conical seat thereby forming a tight seal separating said preparation chamber from said hydrogenation chamber.

3. A method as claimed in claim 1 or 2 wherein said stopping step further comprises disconnecting said rotatable element from said drive means thereby stopping said conveying of said compressed coal in said preparation chamber.

4. A method as claimed in claim 1 further including the step of sealing the pressure in said preparation chamber from said drive means by charging a mixture of coal and oil at pressures higher than in said preparation chamber into an annular sealing groove around said rotatable element.

* * * * *